US007942119B2

(12) United States Patent
Sugiura et al.

(10) Patent No.: US 7,942,119 B2
(45) Date of Patent: May 17, 2011

(54) VARIABLE VALVE MECHANISM

(75) Inventors: Akira Sugiura, Nishio (JP); Tomiyasu Hirano, Hishio (JP); Tamotsu Yamamoto, Nishio (JP)

(73) Assignee: Otics Corporation, Nishio-shi, Aichi-ken (JP)

( * ) Notice: Subject to any disclaimer, the term of this patent is extended or adjusted under 35 U.S.C. 154(b) by 402 days.

(21) Appl. No.: 12/076,324

(22) Filed: Mar. 17, 2008

(65) Prior Publication Data

US 2008/0230023 A1 Sep. 25, 2008

(30) Foreign Application Priority Data

Mar. 22, 2007 (JP) ..... 2007-075589

(51) Int. Cl.
*F01L 1/34* (2006.01)

(52) U.S. Cl. ..... 123/90.16; 123/90.39; 123/90.27

(58) Field of Classification Search ..... 123/90.15, 123/90.16, 90.55, 90.27, 90.39, 90.52
See application file for complete search history.

(56) References Cited

U.S. PATENT DOCUMENTS

| | | | | |
|---|---|---|---|---|
| 4,768,467 | A | 9/1988 | Yamada et al. | |
| 5,033,420 | A | 7/1991 | Matayoshi et al. | |
| 2001/0035140 | A1 | 11/2001 | Fernandez et al. | |
| 2002/0092490 | A1 * | 7/2002 | Harada et al. | 123/90.27 |
| 2004/0003789 | A1 | 1/2004 | Kreuter | |
| 2005/0028768 | A1 | 2/2005 | Ezaki et al. | |
| 2005/0132990 | A1 | 6/2005 | Haas et al. | |

FOREIGN PATENT DOCUMENTS

| | | | |
|---|---|---|---|
| DE | 196 06 796 | | 11/1996 |
| DE | 10 2004 027 054 | A1 | 12/2005 |
| DE | 10 2004 039 503 | A1 | 3/2006 |
| EP | 0 416 628 | A1 | 3/1991 |
| EP | 1 197 640 | A1 | 4/2002 |
| GB | 2 185 784 | A | 7/1987 |
| JP | 64-80712 | | 3/1989 |
| JP | 05-098913 | | 4/1993 |

OTHER PUBLICATIONS

European Search Report dated Aug. 20, 2008.
Japanese Office Action dated Nov. 9, 2010 with an English translation.

* cited by examiner

*Primary Examiner* — Zelalem Eshete
(74) *Attorney, Agent, or Firm* — McGinn IP Law Group, PLLC

(57) ABSTRACT

The present invention provides a variable valve mechanism that varies amounts of opening and closing of a valve includes a rotating cam, a rocker arm, two lash adjusters, a hydraulic passage, and a switching mechanism. The rocker arm includes an input member and an output member. The two lash adjusters support the rocker arm so that the rocker arm can rock. The hydraulic passage includes an internal oil passage that is provided in an interior of at least one of the lash adjusters, and an arm oil passage that is provided in an interior of the rocker arm and that is connected from the internal oil passage. The switching mechanism uses a hydraulic pressure in the hydraulic passage to perform a switching between a linked state and a released state, and the switching varies the amounts of the opening and the closing of the valve.

18 Claims, 5 Drawing Sheets

VARIABLE VALVE MECHANISM

TECHNICAL FIELD

The present invention relates to a variable valve mechanism that controls valve characteristics according to an operating state of an internal combustion engine.

BACKGROUND OF THE INVENTION

A known variable valve mechanism, disclosed in U.S. Patent Application Publication No. 2005-132990, is used in an internal combustion engine to control an amount of lift, a working angle, and opening and closing timings of a valve 107 according to an operating state of the engine. As shown in FIG. 5, in the variable valve mechanism 100, a lash adjuster 104 supports a proximal end of a rocker arm 101. An input member 103 and an output member 102 of the rocker arm 101 are linked such that they cannot rock in relation to one another. A linking pin 105 that releases the link between the input member 103 and the output member 102 is provided in the rocker arm 101.

SUMMARY OF THE INVENTION

However, in the variable valve mechanism 100, a hydraulic mechanism 106 and the like for driving the linking pin 105 are not provided within the rocker arm 101, so the hydraulic mechanism 106 and the like must be provided outside the rocker arm 101 in a cylinder head or the like. The overall structure of the variable valve mechanism 100 thus becomes more complex.

Addressing the problem described above, an object of the present invention is to provide a variable valve mechanism in which the overall structure is simplified by providing a hydraulic passage in an interior of a rocker arm to drive a linking pin, and cost is reduced by using a known lash adjuster with a hemispherical upper end portion.

In order to achieve the object described above, according to the present invention, there is provided a variable valve mechanism that varies amounts of opening and closing of a valve, which comprises: a rotating cam; a rocker arm including an input member that is provided with an input roller that contacts the rotating cam, and an output member that contacts the valve, the rocker arm being disposed between the valve and the rotating cam so as to be able to rock; two lash adjusters that are disposed such that they are separated in the width direction of the rocker arm and that support the rocker arm so that the rocker arm can rock, each upper end portion of the lash adjusters having a hemispherical shape; a hydraulic passage including an internal oil passage that is provided in an interior of at least one of the lash adjusters, and an arm oil passage that is provided in an interior of the rocker arm and that is connected from the internal oil passage; and a switching mechanism. The switching mechanism uses a hydraulic pressure in the hydraulic passage to perform a switching between a linked state, in which the input member and the output member are linked such that the input member and the output member cannot be displaced in relation to one another, and a released state, in which the link between the input member and the output member is released such that the input member and the output member can be displaced in relation to one another. The switching varies the amounts of the opening and the closing of the valve.

There is no particular limit on the variation of the amounts of the opening and the closing of the valve. Examples that can be cited include a case of switching between a state in which the valve is driven according to the rotation of the rotating cam and a state in which the driving of the valve stops completely, a case of switching between a state in which the valve opens and closes according to the rotation of the rotating cam with a comparatively large amount of lift and a state in which the valve opens and closes with a comparatively small amount of lift, and the like.

There is no particular limit on the rocker arm. Examples that can be cited include a configuration in which a center of the rocking motion is provided in a proximal end portion of the rocker arm, the input roller is attached to a central portion in the length direction of the rocker arm, and the valve contacts a distal end portion of the rocker arm, a configuration in which the center of the rocking motion is provided in the central portion in the length direction of the rocker arm, the input roller is attached to a proximal end portion of the rocker arm, and the valve contacts the distal end portion of the rocker arm, and the like.

There is no particular limit on the output member. However, it is desirable for the output member to include two arm-shaped members that are arranged along the width direction of the rocker arm and that contact the separate valves and are supported by the separate lash adjusters, because this configuration makes it possible to reduce the number of the rocker arms in the entire internal combustion engine and makes it possible to absorb variations in the positioning of the lash adjusters that support the rocker arm.

There is no particular limit on the input member. An example can be cited in which the input member is disposed between the two arm-shaped members and is supported so as to be able to rock by a support shaft that is supported at both ends by the arm-shaped members. It is also desirable for the axis line of the support shaft to pass through the spherical centers of the hemispherical upper end portions of the lash adjusters, because this configuration makes it possible to make the rocker arm smaller.

It is desirable for the lash adjuster to include a oil passage that is provided with an opening in the upper end portion of a plunger of the lash adjuster that contacts the rocker arm, such that the hydraulic pressure can be supplied to the switching mechanism within the rocker arm.

There is no particular limit on the switching mechanism. Examples that can be cited include a configuration in which the switching mechanism switches between a linked state, in which the input member and the output member are linked such that they cannot be displaced in relation to one another, and a released state, in which the link between the input member and the output member is released, the switching being accomplished by using the hydraulic pressure to drive the linking pin, which connects the input member and the output member, in the width direction of the rocker arm.

There is no particular limit on the linking pin mounting position. Examples that can be cited include the proximal end portion of the rocker arm, the distal end portion of the rocker arm, the central portion in the length direction of the rocker arm, and the like.

According to the present invention, a variable valve mechanism can be provided in which the overall structure is simplified by including the hydraulic passage in the interior of the rocker arm to drive the linking pin, and the cost is reduced by using a known lash adjuster with a hemispherical upper end portion.

DETAILED DESCRIPTION OF THE INVENTION

Figure 1:
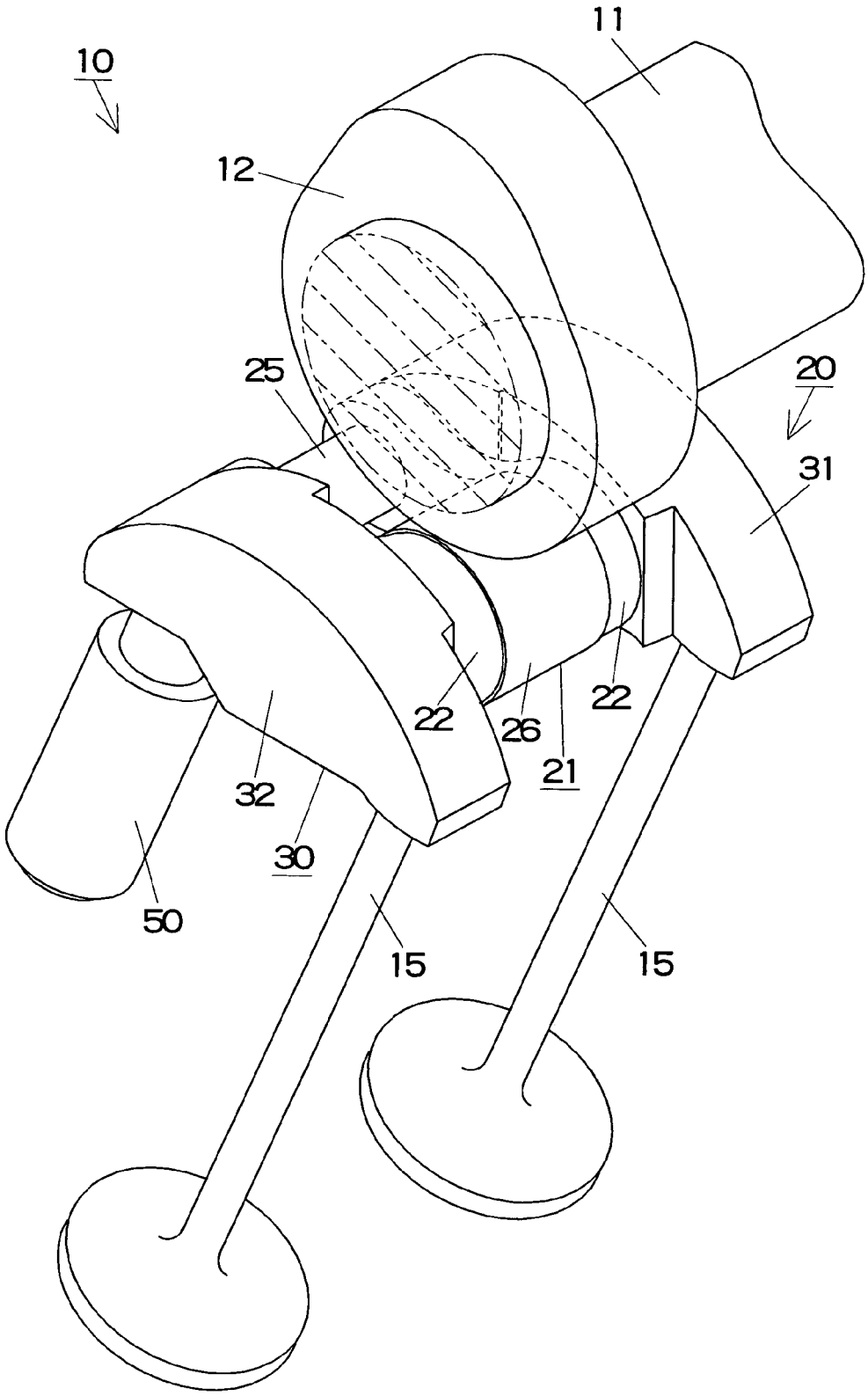
FIG. 1 is an oblique view of a variable valve mechanism according to an embodiment of the present invention.
Figure 2:
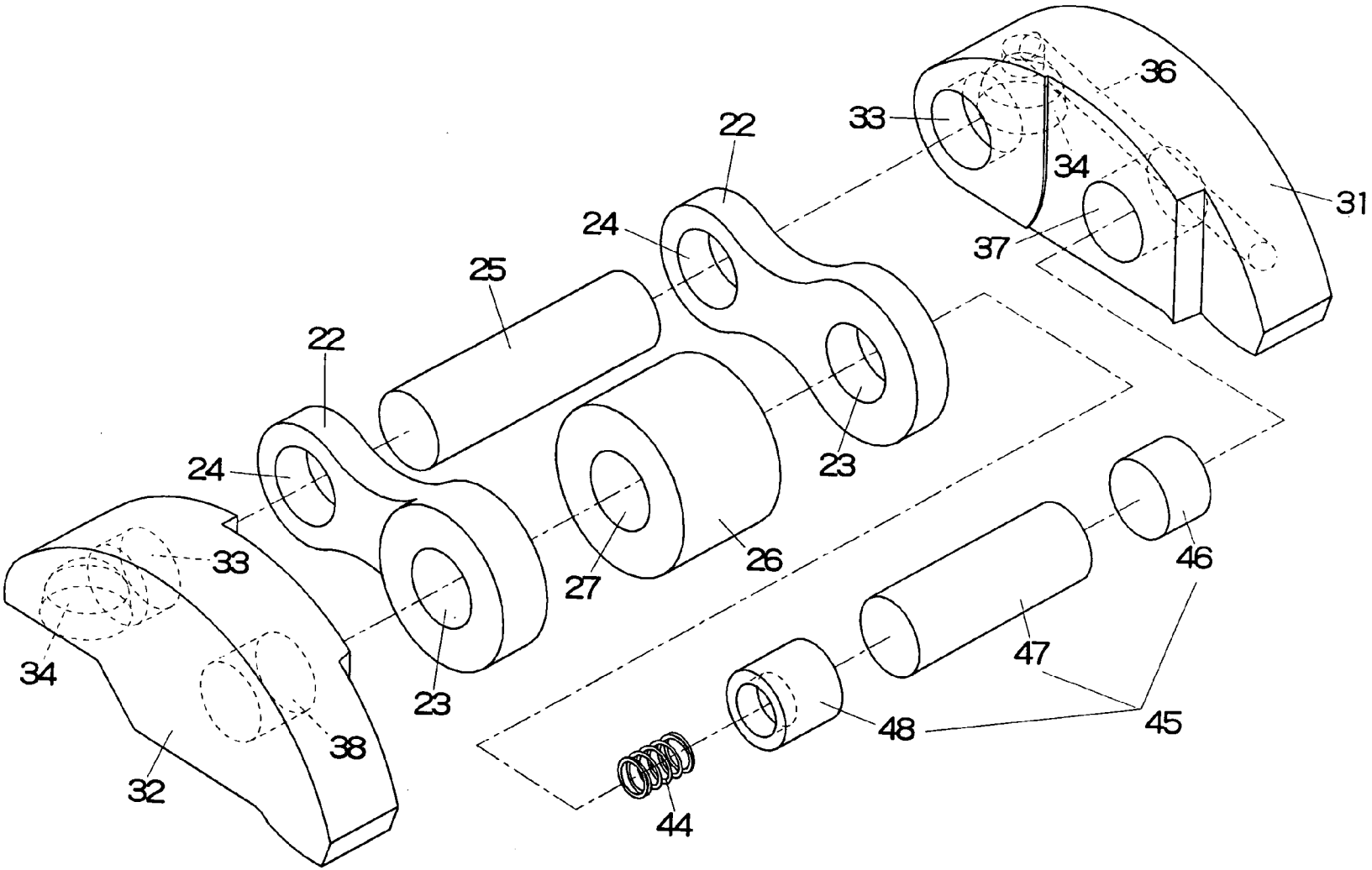
FIG. 2 is an exploded oblique view of a rocker arm in the variable valve mechanism.

A variable valve mechanism that varies amounts of opening and closing of a valve includes a rotating cam, a rocker arm, two lash adjusters, a hydraulic passage, and a switching mechanism. The rocker arm includes an input member that is provided with an input roller that contacts the rotating cam, and an output member that contacts the valve. The rocker arm is disposed between the valve and the rotating cam so as to be able to rock. The two lash adjusters are disposed such that they are separated in the width direction of the rocker arm and that support the rocker arm so that the rocker arm can rock, each upper end portion of the lash adjusters having a hemispherical shape. The output member includes two arm-shaped members that are arranged in a width direction of the rocker arm. The two arm-shaped members contact the separate valves and are supported by the separate lash adjusters. The input member is disposed between the two arm-shaped members, and is supported so as to be able to rock by a support shaft that is supported at both ends by the arm-shaped members. An axis line of the support shaft passes through spherical centers of the hemispherical upper end portions of the lash adjusters. The hydraulic passage includes an internal oil passage that is provided in an interior of at least one of the lash adjusters, and an arm oil passage that is provided in an interior of the rocker arm and that is connected from the internal oil passage. The switching mechanism uses a hydraulic pressure in the hydraulic passage to perform a switching between a linked state, in which the input member and the output member are linked such that the input member and the output member cannot be displaced in relation to one another, and a released state, in which the link between the input member and the output member is released such that the input member and the output member can be displaced in relation to one another. The switching varies the amounts of the opening and the closing of the valve.

The variable valve mechanism according to an embodiment of the present invention is shown in FIGS. 1 to 4.

A variable valve mechanism 10 includes a rotating cam 12, a rocker arm 20, and a switching mechanism 40. The rotating cam 12 is provided on a camshaft 11 that is rotated by an engine crankshaft (not shown). The rocker arm 20 rocks according to a rotation of the rotating cam 12 to open and close valves 15. The switching mechanism 40 intermittently varies the amounts of the opening and closing of the valves 15 by the rocker arm 20.

The rocker arm 20 is structured such that it includes an input arm 21, an output arm 30, and the switching mechanism 40. The input arm 21 is an arm-shaped input member that contacts the rotating cam 12 in a central portion in the length direction of the rocker arm 20. The output arm 30 is an arm-shaped output member that contacts the two valves 15 at a distal end portion of the rocker arm 20. The output arm 30 is conjoined with the input arm 21 at a proximal end portion of the rocker arm 20 such that the input arm 21 and the output arm 30 can rock in relation to one another. The switching mechanism 40 is provided in the central portion in the length direction of the rocker arm 20. The switching mechanism 40 performs the switching between a linked state, in which the input arm 21 and the output arm 30 are linked such that the input arm 21 and the output arm 30 cannot rock in relation to one another, and a released state, in which the links between the input arm 21 and the output arm 30 are released such that the input arm 21 and the output arm 30 can rock in relation to one another. The rocker arm 20 is supported at the proximal end so as to be able to rock by two lash adjusters 50 that are disposed such that they are separated in the width direction of the rocker arm 20.

The output arm 30 includes a first outer arm 31 and a second outer arm 32 that are provided at opposite ends of the input arm 21 such that they are arranged along the length direction of the input arm 21. A distal end portion of each of the output arms 31, 32 contacts the corresponding valve 15, and a proximal end portion of each of the output arms 31, 32 is supported by the corresponding lash adjuster, respectively. A shaft hole 33 that is a bottomed hole is provided in the proximal end portion of each of the output arms 31, 32, on a side that faces the input arm 21. A roughly hemispherical recessed portion 34 is formed in the proximal end portion of each of the output arms 31, 32, with a bottom face that contacts the corresponding lash adjuster 50 and that closely fits an upper end portion of the corresponding lash adjuster 50. An arm oil passage 36 is provided in an interior portion of the first outer arm 31, extending in a length direction of the first outer arm 31 from the recessed portion 34 to a central portion of the first outer arm 31 such that the hydraulic passage is connected from the lash adjuster 50 to the interior of the rocker arm 20. A support shaft 25 that supports the input arm 21 is inserted into the shaft holes 33 in the output arms 31, 32.

The input arm 21 has two inner plates 22, in each of which holes are formed in a distal end portion and a proximal end portion. The inner plates 22 are disposed between the first outer arm 31 and the second outer arm 32 such that they serve as inner arms. In each of the inner plates 22, the hole that is formed in the distal end portion serves as a roller hole 23, and the hole that is formed in the proximal end portion serves as a support hole 24. A linking pin 45 passes through the roller holes 23 in a state that allows the linking pin 45 to slide in its length direction. An input roller 26 that contacts the rotating cam 12 is supported by the linking pin 45 so that the input roller 26 can rotate. The support shaft 25 that supports the input arm 21 such that the input arm 21 can rock passes through the support holes 24 such that the opposite ends of the support shaft 25 are respectively supported by the first outer arm 31 and the second outer arm 32.

The switching mechanism 40 includes pin holes 37, 38, the linking pin 45, and a pin spring 44. The pin holes 37, 38 are bottomed holes that are located in central portions in the length direction of the output arms 30, on the sides that face the input arm 21. The linking pin 45 slides in the length direction of the pin holes 37, 38, making sliding contact with side faces of the pin holes 37, 38. The pin spring 44 contacts an end face of the linking pin 45 and energizes the linking pin 45.

The pin hole provided in the first outer arm 31 serves as a first pin hole 37 and is continuous with the arm oil passage 36. The pin hole provided in the second outer arm 32 serves as a second pin hole 38. The pin spring 44 is provided in the second pin hole 38.

The linking pin 45 includes three roughly cylindrical pins. In order starting from the first outer arm 31, the pins are a first pin 46, a second pin 47, and a third pin 48, with the end faces of adjacent pins touching one another. The end face of the third pin 48 that does not touch the second pin 47 contacts the pin spring 44. Because the pin spring 44 contacts the third pin 48, the linking pin 45 is energized by the pin spring 44 in a direction that removes the linking pin 45 from the second pin hole 38, that is, a direction that inserts the linking pin 45 into the first pin hole 37. Therefore, each of the pins 46, 47, 48 from which the linking pin 45 is configured is energized by the pin spring 44 in the same direction as is the linking pin 45. Furthermore, because the linking pin 45 supports the input roller 26, the second pin 47 passes through a through hole 27 in the input roller 26 and through the roller holes 23 in both of the inner plates 22.

The lash adjusters 50 include plungers 51 whose upper end portions are roughly hemispherical. One of the plungers 51 includes an internal oil passage 52 that is continuous with an opening 53 that is provided in the upper end portion to supply a working fluid P to the switching mechanism 40 within the supported rocker arm 20. The upper end portion of each plunger fits closely into the corresponding recessed portion 34.

The working fluid P that is supplied from the lash adjuster 50 is supplied from a gap between the upper end portion of the plunger 51 and the recessed portion 34, through the arm oil passage 36, to the first pin hole 37.

When a pressure is applied to the working fluid P, the linking pin 45, which is energized by the pin spring 44 in the direction that inserts the linking pin 45 into the first pin hole 37, resists the energizing force of the pin spring 44 such that it slides within both of the pin holes 37, 38 in a direction that removes it from the first pin hole 37, that is, a direction that inserts it into the second pin hole 38.

By contrast, when the applied pressure on the working fluid P is cut off, the energizing force of the pin spring 44 causes the linking pin 45 to slide within both of the pin holes 37, 38 in the direction that inserts it into the first pin hole 37, that is, the direction that removes it from the second pin hole 38. The linking pin 45 thus moves according to the application and cutting off of the pressure on the working fluid P.

Figure 3A:
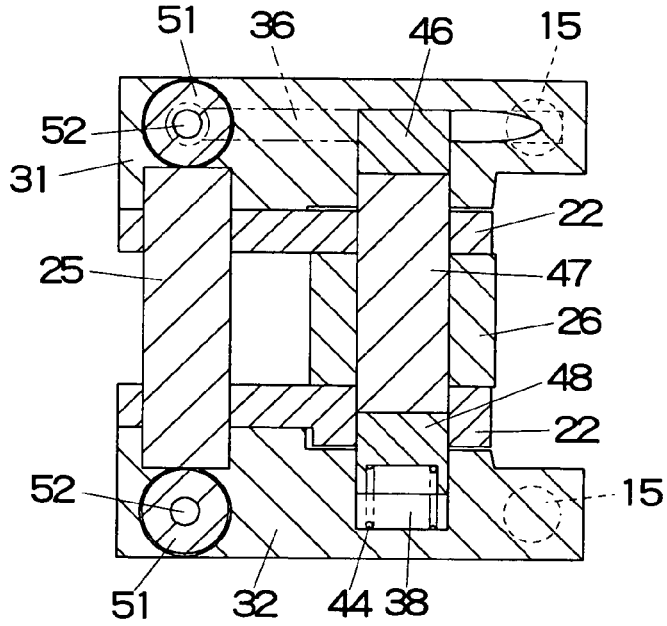
FIG. 3 is a sectional view of the rocker arm.

As shown in FIG. 3A, when the third pin 48 is not in a position where it contacts the bottom of the second pin hole 38, a portion of the third pin 48 is inserted into one of the roller holes 23, and a portion of the second pin 47 is inserted into the first pin hole 37. Therefore, the switching mechanism 40 is in the linked state, in which the input arm 21 and the output arm 30 are linked such that they cannot be displaced in relation to one another.

Figure 3B:
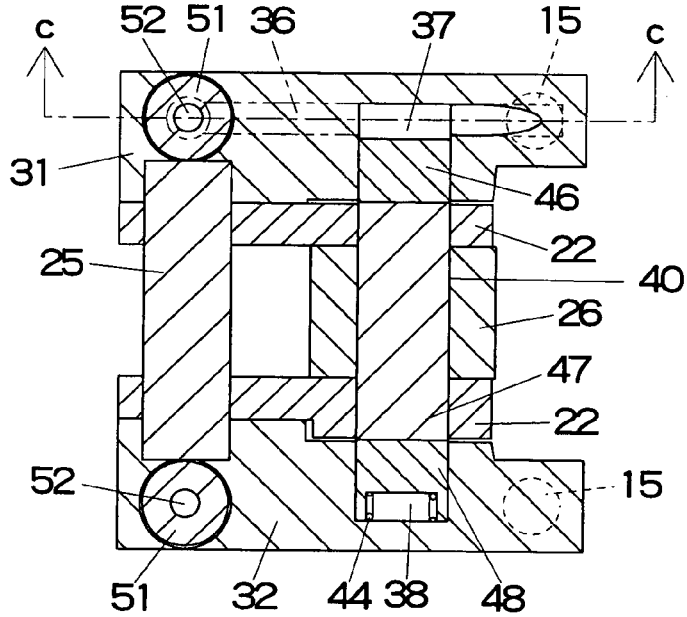
Figure 3C:
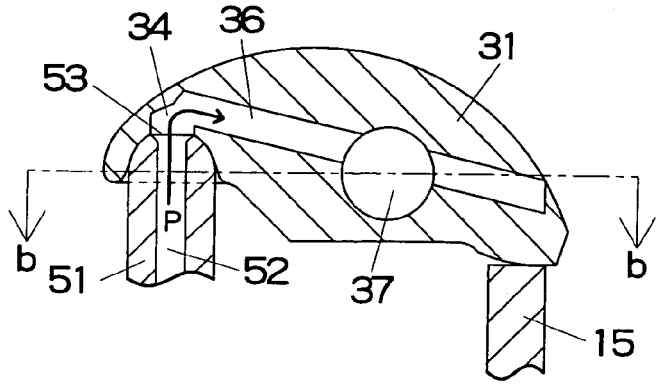

In contrast, when the third pin 48 is in a position where it contacts the bottom of the second pin hole 38, as shown in FIG. 3B, the third pin 48 is removed from the roller hole 23, and the second pin 47 is not inserted into the second pin hole 38. That is, the boundary between the second pin 47 and the third pin 48 has arrived at the gap between the input arm 21 and the second outer arm 32. Moreover, the second pin 47 is removed from the first pin hole 37, and the first pin 46 is not inserted into the roller hole 23. That is, the boundary between the first pin 46 and the second pin 47 has arrived at the gap between the input arm 21 and the first outer arm 31. Therefore, the switching mechanism 40 is in the released state, in which the links between the input arm 21 and the output arm 30 are released such that the input arm 21 and the output arm 30 can be displaced in relation to one another.

Figure 4A:
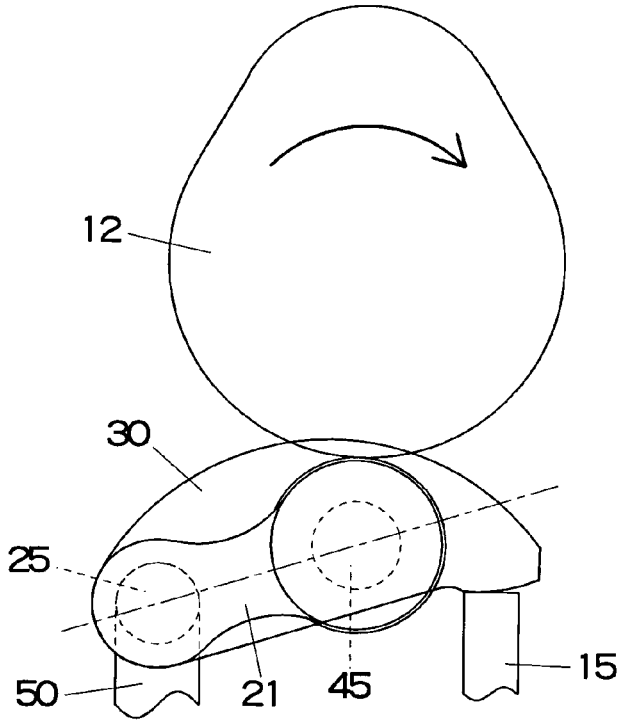
FIG. 4 is a schematic diagram of a rocking state of the rocker arm in the variable valve mechanism.

As shown in FIG. 4, the axis line of the support shaft 25 passes through the spherical centers of the hemispherical upper end portions of the lash adjusters 50. Therefore, regardless of the state of the switching mechanism, when the rotating cam 12 rotates, the input arm 21 rocks in accordance with the rotation of the rotating cam 12, with the rocking centered around the support shaft 25.

Figure 4B:
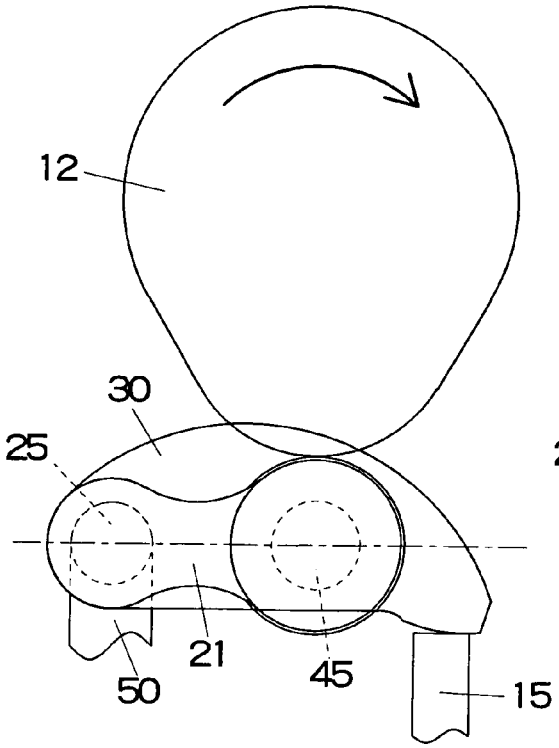

When the output arm 30 is in the linked state with the input arm 21, as shown in FIG. 4B, the output arm 30 rocks in synchrony with the rocking of the input arm 21, with the lash adjusters 50 serving as fulcrums. The rocking of the output arm 30 with the lash adjusters 50 as fulcrums causes the two valves 15 that are in contact with the distal end of the output arm 30 to open and close according to the rotation of the rotating cam 12.

Figure 4C:
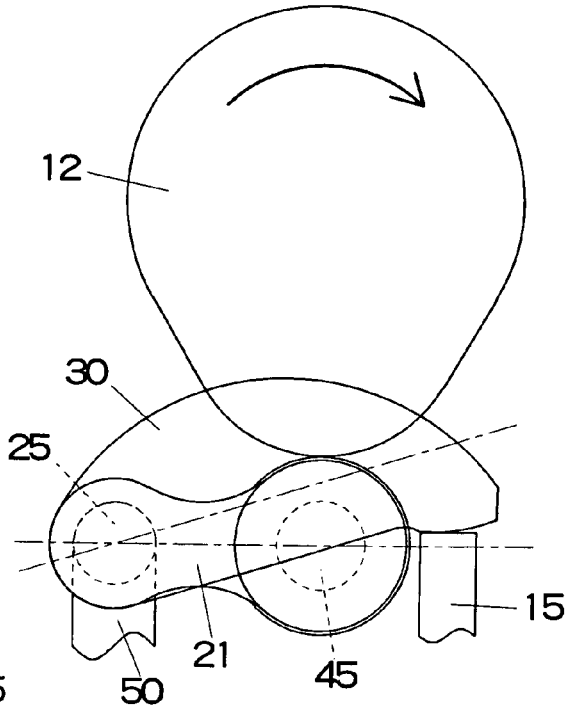
Figure 5:
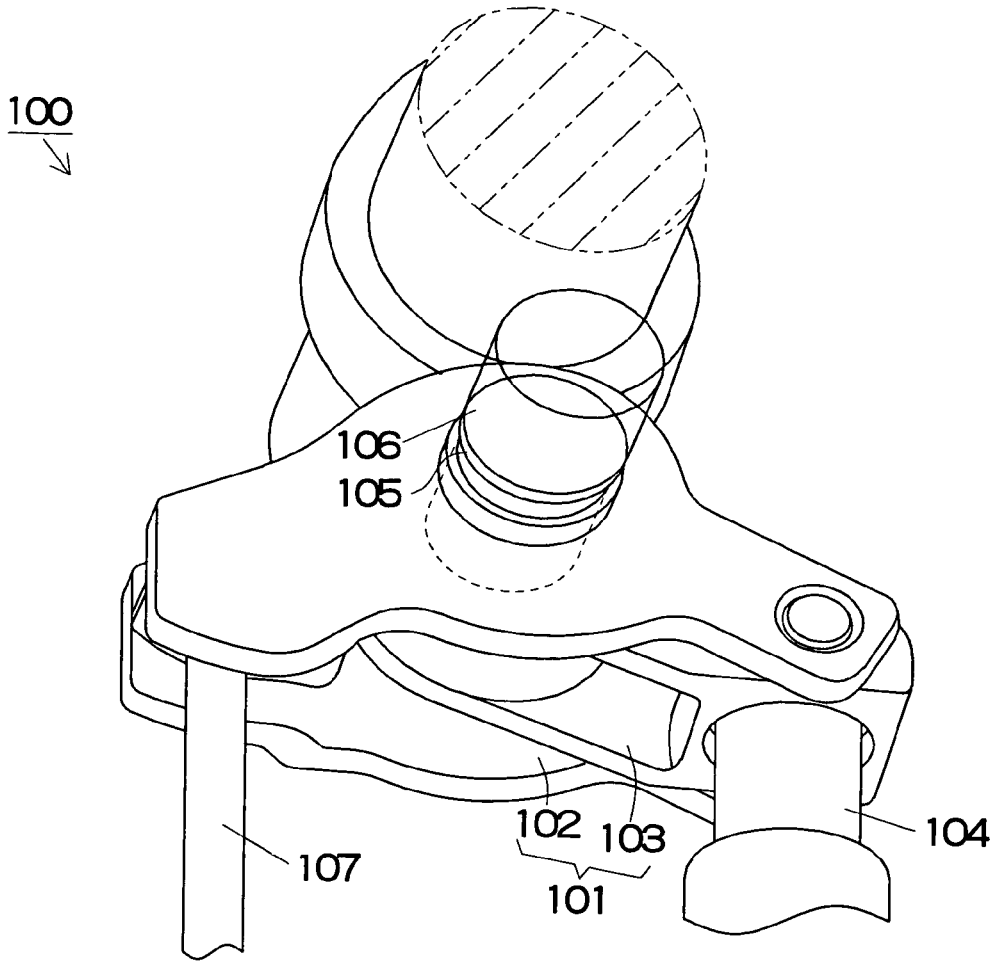
PRIOR ART Fig. 5
FIG. 5 is an oblique view of a known variable valve mechanism.

On the other hand, when the output arm 30 is in the released state in relation to the input arm 21, as shown in FIG. 4C, the output arm 30 is not in synchrony with the rocking of the input arm 21 and so do not rock. Therefore, the valves 15 do not open and close according to the rotation of the rotating cam 12.

According to the present embodiment, effects (a) to (g) below can be obtained.

(a) Providing the hydraulic passage 36 in the interior of the rocker arm 20 makes it possible to simplify the entire variable valve mechanism 10.

(b) Using the known lash adjusters 50 with the hemispherical upper end portions to support the rocker arm 20 helps to reduce the cost of the variable valve mechanism 10.

(c) Using the single rocker arm 20 to drive the two valves 15 makes it possible to reduce the number of the rocker arms 20 in the entire internal combustion engine.

(d) Using the two lash adjusters 50 that support the one rocker arm 20 to support separately the proximal ends of the outer arms 31, 32 makes it possible to absorb variations in the positioning of the lash adjusters 50.

(e) Having the axis line of the support shaft 25 pass through the spherical centers of the hemispherical upper end portions of the lash adjusters 50 makes it possible to make the rocker arm 20 smaller.

(f) Using the two lash adjusters 50, left and right, to support the proximal end portion of the rocker arm 20 makes it possible to prevent the rocker arm 20 from tilting to the left and to the right.

(g) Using the linking pin 45 to support the input roller 26 makes it possible to simplify the rocker arm 20.

Note that the present invention is not limited by the embodiment described above and may be practiced within the scope of the appended claims or the equivalents thereof.

What is claimed is:

1. A variable valve mechanism that varies amounts of opening and closing of a valve, the variable valve mechanism comprising:

a rotating cam;

a rocker arm including:

an input member that is provided with an input roller that contacts the rotating cam; and an output member that contacts the valve, the rocker arm being disposed between the valve and the rotating cam so as to be able to rock;

two lash adjusters that are disposed such that they are separated in the width direction of the rocker arm and that support the rocker arm so that the rocker arm can rock, each upper end portion of the lash adjusters having a hemispherical shape;

a hydraulic passage including:

an internal oil passage that is provided in an interior of at least one of the lash adjusters; and an arm oil passage that is provided in an interior of the rocker arm and that is connected from the internal oil passage;

a switching mechanism that uses a hydraulic pressure in the hydraulic passage to perform a switching between a linked state, in which the input member and the output member are linked such that the input member and the output member cannot be displaced in relation to one another, and a released state, in which the link between the input member and the output member is released such that the input member and the output member can be displaced in relation to one another, the switching varying the amounts of the opening and the closing of the valve; and a support shaft, an axis line of the support shaft passing through spherical centers of the hemispherical shape of the upper end portions of the lash adjusters, wherein the switching mechanism comprises:

a first pin being provided within a first pinhole provided in an interior of the output member;

a second pin being provided within a second pinhole of the output member opposite that of the first pinhole;

a pin-spring being provided between a side face of the second pinhole and the second pin, said pin-spring being configured to bias the second pin away from the side face; and a linking pin provided within an input roller through-hole defined within the input roller, said linking pin being configured to be in contact with the first pin at a first end of the linking pin and the second pin at a second end of the linking pin.

2. The variable valve mechanism according to claim 1, wherein the output member includes two arm-shaped members that are arranged in the width direction of the rocker arm and that contact separate valves and are supported by the separate lash adjusters.

3. The variable valve mechanism according to claim 2, wherein the input member is disposed between the two arm-shaped members, and is supported so as to be able to rock by the support shaft, the support shaft being supported at both ends by the arm-shaped members.

4. The variable valve mechanism according to claim 1, wherein the internal oil passage is continuous with an opening that is provided in an upper end portion of a plunger of the lash adjuster.

5. The variable valve mechanism according to claim 1, wherein the switching mechanism is provided in a central portion in a length direction of the rocker arm.

6. A variable-valve rocker arm, comprising:

an input unit, comprising:

an input roller configured to contact a cam to rotate a rocker arm according to a rotation of the cam, the input roller having an input roller through-hole defined therein;

a first inner plate having a first support hole and a first roller hole defined therein;

a second inner plate having a second support hole and a second roller hole defined therein; and a support shaft commonly provided through the first support hole and the second support hole;

an output unit, comprising:

a first output arm configured to contact a first valve, the first output arm having an arm oil passage, a first pinhole, and a first shaft-hole defined therein, wherein the first shaft-hole is connected to the arm oil passage, and wherein the first shaft-hole receives a first end of the support shaft; and a second output arm configured to contact a second valve, the second output arm having a second pinhole and a second shaft-hole defined therein, wherein the second shaft-hole receives a second end of the support shaft; and a switching unit, comprising:

a first pin being provided within the first pinhole;

a second pin being provided within the second pinhole;

a pin-spring being provided between a side face of the second pinhole and the second pin, said pin-spring being configured to bias the second pin away from the side face; and a linking pin provided within the input roller through-hole, said linking pin being configured to be in contact with the first pin at a first end of the linking pin and the second pin at a second end of the linking pin.

7. The rocker arm according to claim 6, wherein the second pin is contained within the second pinhole in a released state, and wherein the second pin is contained within the second pinhole and the input roller through-hole in a linked state.

8. The rocker arm according to claim 6, wherein, in a linked state, the linking pin is provided within the first pinhole, the first roller hole, the second roller hole, and the input roller through-hole.

9. The rocker arm according to claim 6, wherein, in a released state, the linking pin is contained within the input roller through-hole, the first pin is contained within the first pinhole, and the second pin is contained within the second pinhole.

10. The rocker arm according to claim 6, wherein a hydraulic pressure is provided through the oil passage to push against the first pin, said hydraulic pressure being sufficient to overcome the bias of the pin-spring to push the second pin into the second pinhole.

11. The rocker arm according to claim 6, wherein the input unit rocks about the support shaft.

12. The rocker arm according to claim 6, wherein the first inner plate is provided between the first output arm and the input roller.

13. The rocker arm according to claim 6, wherein the second inner plate is provided between the second output arm and the input roller.

14. The rocker arm according to claim 6, wherein the first output arm is provided adjacent a first side of the input roller and the second output arm is provided adjacent a second side of the input roller.

15. The rocker arm according to claim 7, wherein, in the linked state, the output unit rocks in a synchronicity with the input unit.

16. The rocker arm according to claim 7, wherein, in the released state, the output unit is released from the input unit.

17. The rocker arm according to claim 6, further comprising:

a first lash adjuster; and a second lash adjuster, wherein the first lash adjuster and the second lash adjuster are configured to support the first output arm and the second output arm, respectively, and wherein the first lash adjuster has an oil passage defined therein, the oil passage being associated with the arm oil passage.

18. A variable valve mechanism that varies amounts of opening and closing of a valve, the variable valve mechanism comprising:

a rotating cam;

a rocker arm including:

an input member that is provided with an input roller that contacts the rotating cam, the input member having a roller hole defined within a distal end portion of the input member;

a linking pin passing through the roller hole so as to slide in a length direction thereof, the linking pin rotatably supporting the input roller; and an output member that contacts the valve, the rocker arm being disposed between the valve and the rotating cam so as to be able to rock;

two lash adjusters that are disposed such that they are separated in a width direction of the rocker arm and that support the rocker arm so that the rocker arm can rock, each upper end portion of the lash adjusters having a hemispherical shape;

a support shaft, an axis line of the support shaft passing through spherical centers of the hemispherical shape of the upper end portions of the lash adjusters;

a hydraulic passage including:

an internal oil passage that is provided in an interior of at least one of the lash adjusters; and an arm oil passage that is provided in an interior of the rocker arm and that is connected from the internal oil passage; and a switching mechanism that uses a hydraulic pressure in the hydraulic passage to perform a switching between a linked state, in which the input member and the output member are linked such that the input member and the output member cannot be displaced in relation to one another, and a released state, in which the link between the input member and the output member is released such that the input member and the output member can be displaced in relation to one another, the switching varying an amount of an opening and a closing of the valve, the linking pin being driven by the hydraulic pressure, wherein the output member includes first and second arm-shaped members that are arranged in the width direction of the rocker arm and that contact separate valves and are supported by a respective one of the two lash adjusters, wherein the first and second arm-shaped members each have a substantially hemispherical recessed portion defined at a proximal end portion thereof with a bottom face that closely contacts the hemispherical shape of the upper end portion of a corresponding lash adjuster, wherein the first arm-shaped member has the arm oil passage defined in an interior portion extending in a length direction of the first arm-shaped member from the recessed portion to a central portion of the first arm shaped member, and wherein the first and second arm-shaped members have a shaft hole defined in the proximal end portion of each of the first and second arm-shaped members on a side that faces the input arm, the support shaft being inserted into the shaft holes.

* * * * *